United States Patent [19]

Strausburg

[11] 4,049,178

[45] Sept. 20, 1977

[54] TAG ATTACHER

[75] Inventor: Larry D. Strausburg, Miamisburg, Ohio

[73] Assignee: Monarch Marking Systems, Inc., Dayton, Ohio

[21] Appl. No.: 683,101

[22] Filed: May 12, 1976

Related U.S. Application Data

[63] Continuation-in-part of Ser. No. 587,745, June 17, 1975, Pat. No. 3,973,710.

[51] Int. Cl.[2] ..... B25C 5/06

[52] U.S. Cl. ..... 227/67

[58] Field of Search ..... 227/67

[56] References Cited

U.S. PATENT DOCUMENTS

| | | | |
|---|---|---|---|
| 3,650,452 | 3/1972 | Finke | 227/67 |
| 3,973,710 | 8/1976 | Strausburg | 227/67 |

*Primary Examiner*—Granville Y. Custer, Jr.
*Attorney, Agent, or Firm*—Joseph J. Grass

[57] ABSTRACT

There is disclosed a hand-held apparatus for attaching tags to merchandise. Apparatus according to the invention uses a fastener assembly having a plurality of fasteners. Each fastener has a bar section and a button or head section joined by a filament section. Each bar section is connected to a common runner or rail by a respective neck or connector. The apparatus causes one fastener at a time to be severed from the connector at the intersection of its bar section and the respective connector. The bar section of the severed fastener is pushed by a push rod through an elongated bore of a needle while the filament section passes along a side opening in the needle which communicates with the needle bore. Fastener assembly advancing means includes a toothed member and a movable member. In one embodiment, a pawl member includes a first flexible resilient arm having a tooth at its free end portion cooperable with the toothed member and a second flexible resilient arm connected to the pawl member, cooperable with a guide and movable with the pawl member. In another embodiment, relatively movable slides are coupled by a lost-motion connection. A one-piece pawl coupled to one of the slides has a tooth cooperable with the toothed member and a flexible resilient arm cooperable with a guide for urging the tooth into cooperation with the toothed member.

4 Claims, 12 Drawing Figures

FIG-8
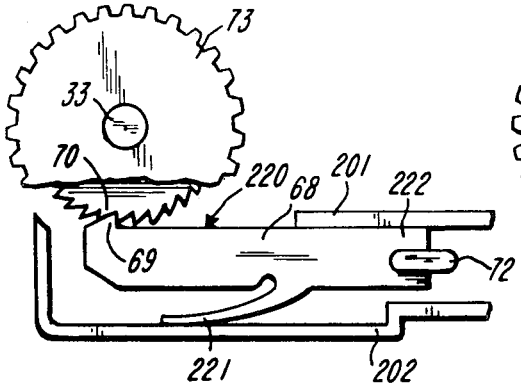
FIG-9
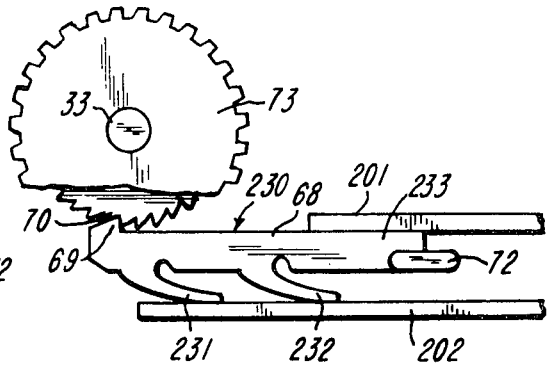
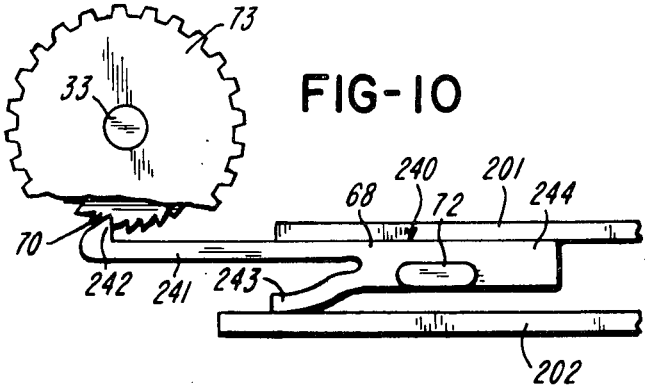
FIG-11
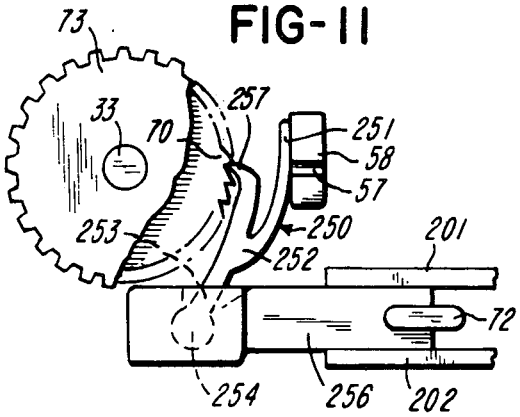
FIG-12
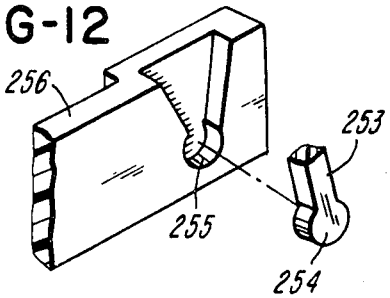

TAG ATTACHER

CROSS-REFERENCE TO RELATED APPLICATION

This is a continuation-in-part of application Ser. No. 587,745, filed June 17, 1975, now U.S. Pat. No. 3,973,710, issued Aug. 10, 1976.

BACKGROUND OF THE INVENTION

1. Field of the Invention

This invention relates to the art of applying fasteners and specifically to apparatus for attaching tags to articles such as merchandise by means of fasteners.

2. Brief Description of the Prior Art

A commercially successful tag attached is disclosed in U.S. Pat. No. 3,650,452 to Eugene W. Finke, granted Mar. 21, 1972. That tag attacher discloses a one-piece ratchet wheel and feed wheel. A one-piece spring device has a pair of spring fingers. One spring finger urges a pawl into contact with the ratchet wheel and the other spring finger contacts the toothed feed wheel and acts as a detent or anti-back up device. This tag attacher has also been made using posts molded integrally with one body section to receive headed screws passing through the other body section.

The other devices disclosing drive pawls and detent members are U.S. Pat. Nos. 3,103,666 to Arnold R. Bone, granted Sept. 17, 1963 and U.S. Pat. No. 3,759,435 to Arnold R. Bone, granted Sept. 18, 1973. These patents disclose a means for disengaging the pawl from the feed wheel to facilitate release and removal of a fastener assembly.

Another prior art tag attacher contains a detent pawl which is released by camming action, and it contains a reciprocable pawl having a spring finger which contacts a toothed feed wheel to advance its feed wheel and in turn to advance a fastener assembly.

Summary of the Invention

The invention is directed to an improved tag attacher in which the fastener assembly advancing means comprises a movable member which is guided in its movement by a guide. In one embodiment, a pawl member has an appended flexible resilient arm; the arm moves as a unit with the pawl member in guided contact with a first guide and urges the pawl member into cooperation with the toothed member and a second guide. In yet another embodiment, a movable member has a plurality of flexible resilient arms in guided contact with a first guide and another arm in guided contact with a second guide. The flexible resilient arms urge the member into cooperation with the toothed member and urge the other arm into guided contact with the second guide. In still another embodiment, the pawl member includes a flexible resilient arm having a tooth at its free end portion, a flexible resilient arm in guided contact with a first guide, and another arm in guided contact with a second guide. The flexibility and resiliency of the flexible resilient arms enables them to deflect as the tooth cooperates with the toothed wheel. In yet another embodiment, relatively movable slides are connected by a lost-motion connection and a one-piece pawl member is coupled to one of the slides. An arm integrally connected to the pawl member is guided by a guide and a tooth of the pawl member is cooperable with the toothed member.

BRIEF DESCRIPTION OF THE DRAWINGS

FIG. 8 is a fragmentary side elevational view showing another embodiment having a one-piece toothed member guided for movement relative to a toothed wheel;

FIG. 9 is a fragmentary side elevational view showing yet another embodiment having a one-piece toothed member guided for movement relative to a toothed wheel;

FIG. 10 is a fragmentary side elevational view showing still another embodiment having a one-piece toothed member guided for movement relative to a toothed wheel;

FIG. 11 is a fragmentary side elevational view showing yet another embodiment having a one-piece movable member cooperable with the toothed wheel and guided for movement relative to a toothed wheel and cooperable slides; and FIG. 12 is a fragmentary perspective view of one of the slides and the toothed member.

DESCRIPTION OF THE PREFERRED EMBODIMENT

Figures 1, 2, 3, 4, 5, 6, 7:
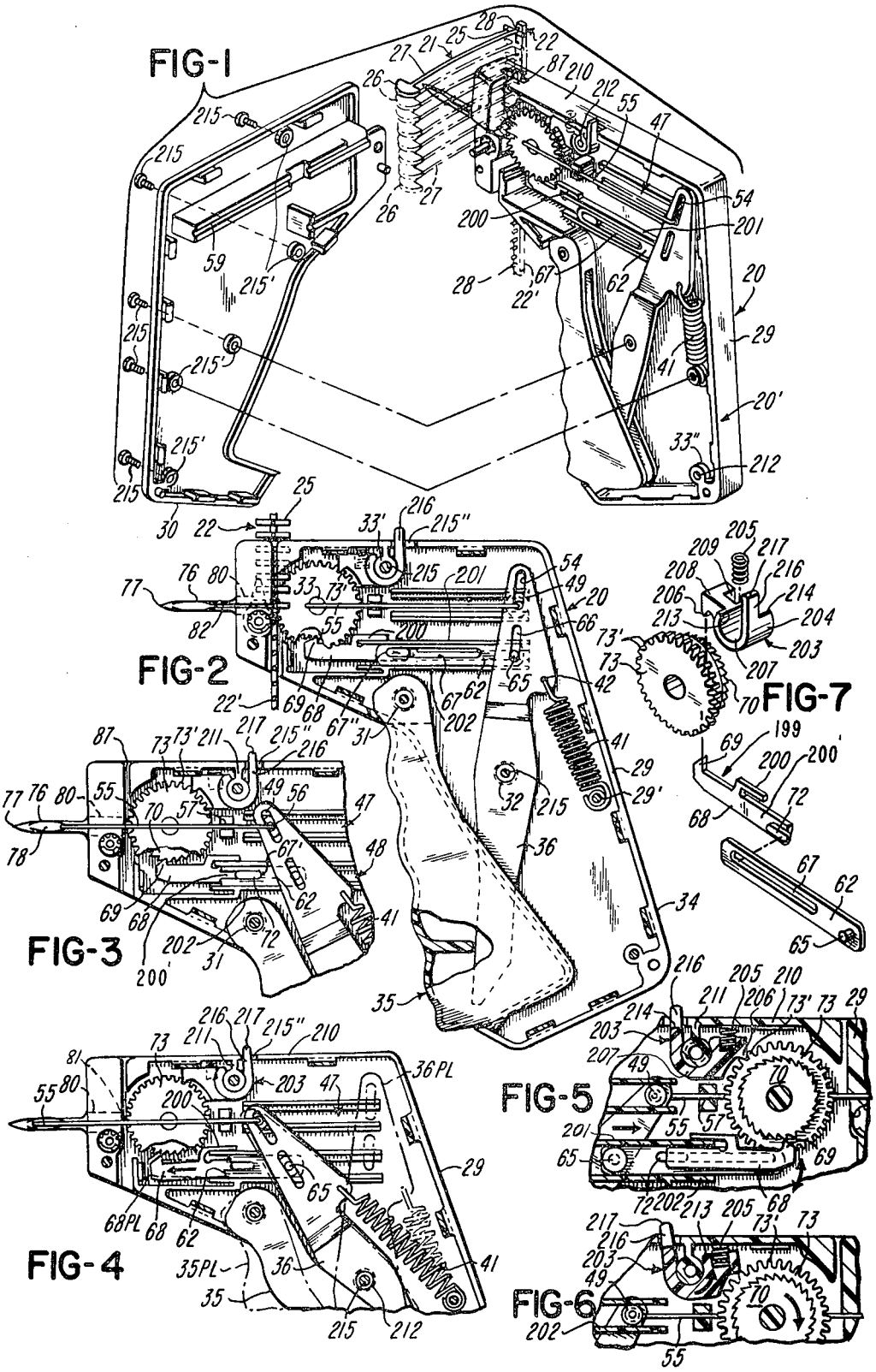
FIG. 1 is an exploded perspective view of a tag attaching apparatus according to the invention.
FIG. 2 is a side elevational view of a portion of the tag attaching apparatus, with one body section removed for clarity.
FIG. 3 is a side elevational view of a fragmentary part of the apparatus, showing the driving mechanism as having moved away from the retracted position shown in FIGS. 1 and 2 and being in a position in which the pawl can be driven to the left as viewed in FIG. 3.
FIG. 4 is a view similar to FIG. 3, but showing the pawl and various levers in different positions.
FIG. 5 is a fragmentary side elevational view partly in section looking at the other side of the apparatus from that shown in FIGS. 2, 3 and 4, with the pawl moving to the right in FIG. 5.
FIG. 6 is a view similar to FIG. 5, but showing the ratchet and feed wheels as advancing and showing the detent member as having pivoted to a different position than shown in FIG. 5.
FIG. 7 is an exploded perspective view of the one-piece ratchet and feed wheels, the pawl, the slide and the detent member.

Referring to the drawings, there is shown apparatus 20 that uses fasteners generally indicated at 21 which are interconnected to provide a fastener assembly 22. Each fastener 21 of the assembly 22 includes a bar section 25 and a button or head section 26 joined by a filament or string section 27.

The fastener assembly 22 is constructed of plastics material such as nylon or the like and can be molded into a unitary construction such that each of the fasteners 21 is integrally connected to a rod or runner 22' by a connector 28.

With particular reference to FIGS. 1 and 2, the apparatus 20 is shown to include a body 20' constructed of body sections or side plates 29 and 30. The body section 29 has posts or pivots 29', 31, 32, 33, 33' and 33'' preferably molded integrally therewith. The body section 29 has a handle portion 34 which is adapted to fit against the palm of the user's hand. An operating member or lever 35 pivotally mounted by the pivot 31 is engageable by the user's fingers. When squeezed, the lever 35 is pivoted counterclockwise and an associated drive lever 36 is also pivoted counterclockwise. A spiral tension spring 41 is connected to one end to the post 29' and at its other end through a hole 42 in the lever 36. The tension spring 41 urges the lever 36 clockwise (FIG. 3) to its retracted or initial position shown in FIGS. 1 and 2. The body section 29 has guides generally indicated at 47 and 48. A slide or guided member 49 is guided by the guide 47 and a slide or guided member 62, guided by the guide 48, has an integrally formed pin or projection 65 received in an elongated slot 66 in the lever 36. A push or drive rod 55 has a bent portion or pin 56 which extends into an elongated slot 54 and is received by the guided member 49. The push rod 55 is thus guided at its one end by the slide 49 and along its length by grooves 57 and 59. The slide 62 is shown to have an elongated slot or cutout 57. Pawl 68 has a tooth 69 shown to be in engagement with a toothed wheel which is shown to take the form of a ratchet wheel 70. The pawl 68 has a pin or boss 72 which is received in the elongated slot 67. The pawl 68 cooperates with the ratchet wheel 70 to provide a pawl and ratchet mechanism. The ratchet wheel 70 is shown to be formed integrally with a toothed member shown to take the form of a feed wheel 73 which engages the connectors 28 to feed the fastener assembly 22 through the apparatus 20.

There is shown a tubular member, specifically a needle, generally indicated at 76 mounted by the body section 29. The needle 76 terminates at a pointed piercing end 77 and has an elongated bore 78 and an elongated slot 82 in the side of the needle 76 which communicates with the bore 78. The elongated slot 82 is wide enough to allow the filament section 27 adjacent the bar section 25 to pass along the slot 82 while the the bar section 25 is passing through the bore 78. The needle 76 has an enlarged portion 80 which terminates at a cutting edge 81. The push rod 55 is guided in its reciprocating movement in alignment with the bore 78. As the operator 35 is actuated from the position shown in FIGS. 1 and 2 to the position shown in FIG. 4, the push rod 55 pushes on the end of a bar section 25 which is in alignment with the bore 78 to cause the bar section 25 to be severed from its respective connector 28. In the position shown in FIG. 3, the pin 72 is just in contact with an abutment 67' formed by one end of the slot 67, so that continued movement of the slide 62 to the left will cause the pawl 68 to move to the left from the position shown in FIG. 3 to the position shown in FIG. 4 to move the tooth 69 of the pawl 68 over one tooth of the ratchet wheel 70. When the counterclockwise movement of the actuator 35 is complete, the bar section 25 has moved completely through bore 78 to the other side of the material to which the tag is to be applied. Upon release of the operating lever 35, the return spring 41 returns the lever 36, the actuator 35, the push rod 55, the slide 62 and the pawl 68 to their retracted or initial positions shown in FIGS. 1 and 2. Just before these components reach their initial positions, the other end 67" of the slot 67 abuts the pin 72 to cause counterclockwise rotation of the ratchet and feed wheels 70 and 73 (FIGS. 2 and 3), thereby advancing the fastener assembly 22 until the next successive bar section 25 is in axial alignment with the bore 78 in the needle 76. The body section 29 includes a slot or guideway 87 for guiding the fastener assembly 22. The foregoing is a brief description of the apparatus disclosed in U.S. Pat. No. 3,650,452.

Referring now to the improvements of the present invention, a flexible resilient arm or spring finger 200 is connected to the pawl 68. The arm 200, which is in the shape of a leaf spring, is shown to extend generally parallel to the pawl 68 and to exert a force on the pawl 68 so that the pawl 68 is urged into contact with the ratchet wheel 70. As the pawl tooth 69 moves over a tooth of the ratchet wheel 70 as shown by the solid line position in FIGS. 4 and 5, the pawl 68 can deflect slightly, but this is shown exaggeratedly in FIGS. 4 and 5. When the lever 35 has moved to the solid line position shown in FIG. 4, and the pawl 68 has moved over the next tooth on the ratchet wheel 70, as shown by phantom lines 68PL, the arm 200 returns the pawl 68 to its original position of generally parallel orientation with the guide means 48. The guide means 48 includes spaced apart guides or guide members 201 and 202. The arm 200 is shown to be in sliding contact with guide 201. Phantom lines 35PL and 36PL show the respective levers 35 and 36 in their initial or retractable positions. A part of the slide 62 is broken away in FIGS. 3 and 4 to better show the pawl 68.

With reference to FIGS. 2, 5 and 6, for example, there is shown a detent mechanism generally indicated at 203. The detent mechanism 203 is shown to include a detent member 204 and a spring 205 for urging the detent member 204 counterclockwise in FIG. 2 and clockwise in FIGS. 5 and 6. The detent member 204 is shown to include a tooth 206, a socket or socket portion 207 and an arm 216. The tooth 206, the socket 207 and the arm 216 are preferably of one-piece molded plastic construction. The tooth 206 is shown in FIGS. 2 and 5 to be disposed between adjacent teeth 73' of the toothed wheel 73. In the position shown in FIGS. 2 and 5 the detent member 204 is effective to hold the toothed member 73 and hence also the toothed wheel or ratchet wheel 70 against accidental movement. One end portion of the spring 205 is shown to be received in a recess or pocket 209 in the detent member 204. The other end of the spring abuts a wall 210 of the body section 29. The post 33' which is shown to extend parallel to the post 33, which rotatably mounts the ratchet and feed wheels 70 and 73, is joined to the wall 210 by a rib 211. The post 33' and posts 29', 31, 32 and 33", have respective holes 212. The socket portion 207 is received about the annular outer surface of the post 33'. The angular extent of the socket portion 207 which is in contact with the outer surface of the post 33' is more than 180° so that the detent member 204 is held captive on the post 33'. It is preferable that the angular extent of the socket portion 207 be less than 360° so that the detent member 204 is free to pivot about the post 33' notwithstanding the presence of the rib 211. The end portions 213 and 214 of the socket portion 207 are spaced apart so as to provide clearance with the rib 211. The wall 210 has a hole 215" into which the arm or extension 216 of the detent member 204 can extend. It is preferred that end portion 217 of the extension 216 be slightly above the outer surface of the wall 210. The user can disengage the detent member 204 from the toothed wheel 73 by depressing the end portion 217. This will cause detent member 204 to pivot clockwise in FIG. 2 and counterclockwise in FIGS. 5 and 6 so that the tooth 206 will clear teeth 73' of the tooth member 73. Release of the detent member 204 is especially useful when it is desired to withdraw a fastener assembly 22 from the guideway 87 of the apparatus 20. By depressing the end portion 217 and by squeezing the actuator 35 slightly so as to move the pin 72 away from abutment 67' of the slide 62, the fastener assembly 22 can be readily removed. It is preferred that the tooth 206, the socket portion 207 and the arm 216 be of one-piece molded plastics construction.

Fasteners in the form of self-tapping screws 215 are shown to extend through respective holes 215' in the body section 30 and are received in holes 212 in the respective posts 29', 31, 32, 33' and 33". Accordingly, the post 33' is used to receive the respective fastener 215 and also to mount the detent member 204.

The embodiments of FIGS. 8, 9, 10, and 11 and 12 are identical to the embodiment of FIGS. 1 through 7 except as indicated below and as shown in the drawings.

In the embodiment of FIG. 8, a one-piece molded plastics member generally indicated at 220 is shown to include a flexible resilient arm or spring finger 221, the pawl member 68 and an arm 222. The pin 72 fits into the cutout or slot 67 in the slide 62 (FIG. 2 for example). The arm 221 is shown to be in contact with the guide 202 and to exert a force on the pawl member 68 in opposition to the force exerted by the toothed member or ratchet wheel 70 and in opposition to the force exerted by the guide 201 on the arm 222. As the slide 62 moves the member 220 to the left, the tooth 69 moves over a tooth of the toothed member 70 and in so doing the member 220 cants with respect to the guides 201 and 202 and with respect to the toothed member 70. The member 220 is subsequently moved to the right by the slide 62 and thereupon the member 220 returns to the initial position shown in FIG. 8 and in so doing drives the toothed member 70 and in turn the toothed member 73.

In the embodiment of FIG. 9, a one-piece molded plastics member generally indicated at 230 is shown to include a plurality and specifically two, spaced apart flexible resilient arms or spring fingers 231 and 232, the pawl member 68, and an arm 233. The arms 231 and 232 are shown to be in contact with the guide 202 and to exert a force on the pawl member 68 in opposition to the force exerted by the toothed member 70 and in opposition to the force exerted by the guide 201 on the arm 233. As the slide 62 moves the member 230 to the left, the tooth 69 moves over a tooth of the toothed member 70 and in so doing the member 230 cants with respect to the guides 201 and 202 and with respect to the toothed member 70. The member 230 is subsequently moved to the right by the slide 62 and thereupon the member 230 returns to the initial position shown in FIG. 9 and in so doing drives the toothed member 70 and in turn the toothed member 73.

In the embodiment of FIG. 10, a one-piece molded plastics member generally indicated at 240 is shown to include a flexible resilient arm or spring finger 241 having a tooth 242 at its free end portion, a flexible resilient arm or spring finger 243, the pawl member 68 and an arm 244. The arm 243 is in guided contact with the guide 202. In that both arms 241 and 243 are flexible and resilient both arms 241 and 243 deflect or flex as the member 240 is driven to the left and the pawl 68 can cant slightly. Subsequently, the member 240 moves to the right to return the member 240 to its initial position shown in FIG. 9 and in so doing drives the toothed member 70 and in turn the toothed member 73.

In the embodiment of FIGS. 11 and 12, a one-piece molded plastics member 250 is shown to include a flexible resilient arm or spring finger 251, a pawl member 252 and an arm 253 having an arcuate connector 254. The connector 254 is received in a mating socket on joint 255 in a slide 256. The socket 255 extends through more than 180° but considerably less than 360°. The slide 256 is slidably mounted between guides 201 and 202. The slide 256 is connected to the slide 62 through the lost-motion connection provided by the pin 72 cooperating in cutout or slot 67. When the slide 62 nears the end of its travel to the left, abutment end 67" contacts the pin 72 and drives the slide 256 to the left to move the member 250 relative to the slide 256 as the connector 254 pivots in the socket 255. The arm 251 which bears against post or guide 58, urges tooth 257 against the toothed member 70 and as the tooth 257 rides over a tooth of the toothed member 70, the member 250 moves to the ready position. When the slide 62 nears the end of its travel to the right, the pin 72 contacts abutment face 67' and drives the slide 256 to the right and causes the member 250 to return to its initial position shown in FIG. 11 thereby advancing the wheels 70 and 73. The guide 58 has the guide groove 57 for the push rod 55.

Other embodiments and modifications of this invention will suggest themselves to those skilled in the art, and all such of these as come within the spirit of this invention are included within its scope as best defined by the appended claims.

I claim:

1. Apparatus for attaching tags using fasteners, each fastener including a bar section and a button section joined by a filament section, the apparatus comprising: a body, a needle mounted by the body, the needle having an elongated slot communicating with the bore, a push rod engageable with the bar section of a fastener for driving the bar section through the bore while its filament section extends through the slot, means for advancing one fastener at a time into alignment with the bore including a toothed member, a movable member, means for driving the movable member to advance the toothed member and for driving the push rod, first and second guides secured to the body for guiding the movable member, the movable member including a flexible resilient first arm in slidable contact with the first guide, a second arm in slidable contact with the second guide, a flexible resilient third arm having a tooth cooperable with the toothed member, the first guide being cooperable with the first arm to urge the tooth into contact with the toothed member and to urge the second arm into contact with the second guide, both the first and third arms being yieldable as the pawl tooth moves relative to the toothed member.

2. Apparatus as defined in claim 1, wherein the pawl member and the arms are of a one-piece plastics construction.

3. Apparatus for attaching tags using fasteners, each fastener including a bar section and a button section joined by a filament section, the apparatus comprising: a body, a needle mounted by the body, the needle having an elongated bore and an elongated slot communicating with the bore, a push rod engageable with the bar section of the fastener for driving the bar section through the bore while its filament section extends through the slot, means for advancing one fastener at a time into alignment with the bore including a toothed member, a movable pawl member cooperable with the toothed member, means for driving the pawl member to advance the toothed member and for driving the push rod, the driving means including relatively movable slides and a lost-motion connection between the slides, a one-piece pawl member having a tooth cooperable with the toothed member and having an integrally formed flexible resilient arm for urging the tooth into cooperation with the toothed member, and means for movably coupling the one-piece pawl member to one of the slides so that as the slide to which the pawl member is coupled moves the pawl member will be moved relative to the toothed wheel.

4. Apparatus as defined in claim 3, including a guide post connected to the body, a guide groove in the post for guiding the push rod, and the flexible resilient arm bearing against the post.

* * * * *